United States Patent [19]

Herbert et al.

[11] 4,067,171

[45] Jan. 10, 1978

[54] METHOD OF MAKING MULTIPLE ENCLOSURE MAILER

[75] Inventors: Everett H. Herbert, Fairfield; Randolph S. Lyon, Jr.; Kurt E. Volk, Jr., both of Westport; Robert W. Wassmer, Fairfield, all of Conn.

[73] Assignee: Kurt H. Volk, Inc., Milford, Conn.

[21] Appl. No.: 766,552

[22] Filed: Feb. 7, 1977

[51] Int. Cl.[2] ..... B31B 49/04

[52] U.S. Cl. ..... 53/31; 93/63 M

[58] Field of Search ..... 93/63 M, 63 R, 61 R; 53/206, 31; 229/69, 92.1

[56] References Cited

U.S. PATENT DOCUMENTS

| | | | |
|---|---|---|---|
| 3,374,940 | 3/1968 | Allison | 93/61 R |
| 3,557,519 | 1/1971 | Lyon, Jr. | 93/63 M UX |
| 3,808,768 | 5/1974 | Dobbs | 53/31 |
| 3,998,138 | 12/1976 | Walters | 53/31 X |
| 4,031,818 | 6/1977 | Kehoe | 93/63 R |

*Primary Examiner*—James F. Coan

*Attorney, Agent, or Firm*—Thomas E. Spath

[57] ABSTRACT

Methods for preparing multiple separate personalized enclosures such as lettersheets, forms, return-mail applications and the like, contained in an envelope, which enclosures and envelope are prepared from two or more integral sheets.

11 Claims, 10 Drawing Figures

10A
FORM PRINTER "A"
COMPUTER DIRECTED PRINTER PERSONALIZATION "A"
DIE CUTTER "A"
10B
FORM PRINTER "B"
COMPUTER DIRECTED PRINTER PERSONALIZATION "B"
DIE CUTTER "B"
GLUING AND MATING
LINE HOLE DIE CUTTING AND REMOVAL
MATED COMPOSITE SHEET BURSTING
FOLDING
1
2
ENCLOSURE EDGE TRIMMING
FOLDING
3
ENVELOPE EDGES GLUED AND SEALED
SEPARATING ENVELOPE AND ENCLOSURES

FIG.3
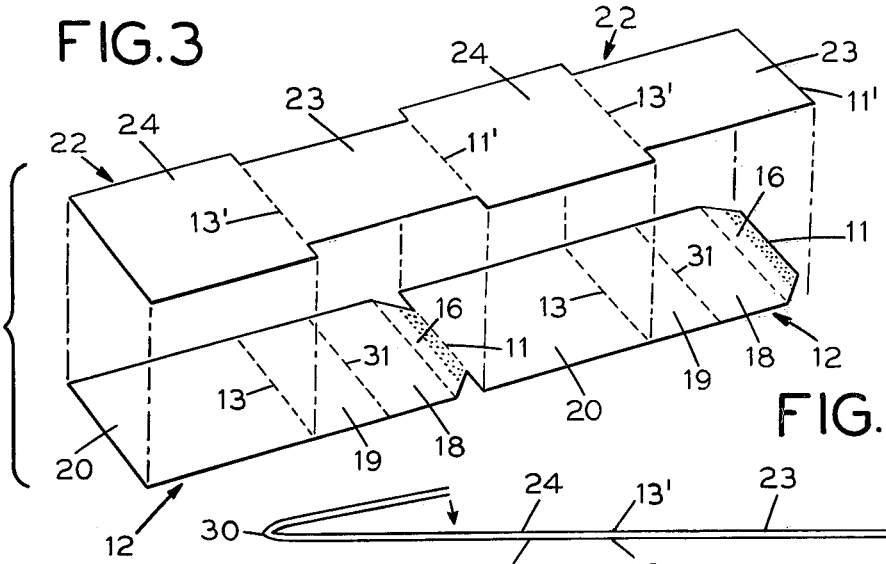
FIG.4
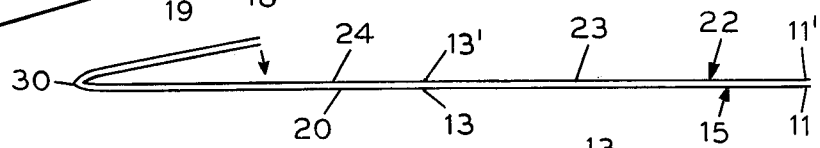
FIG.5
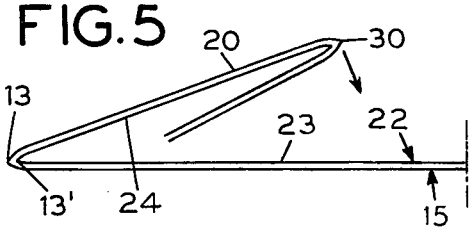
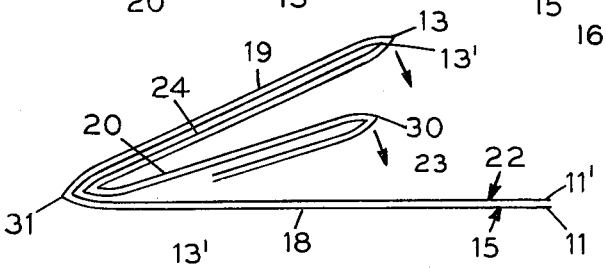
FIG.6
FIG.7
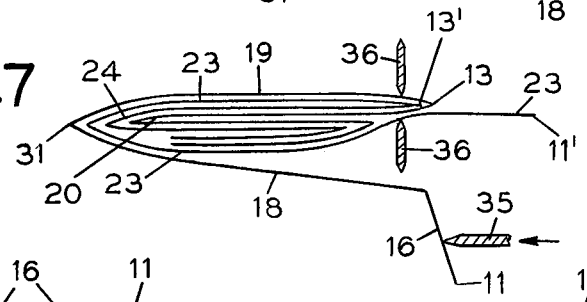
FIG.8A
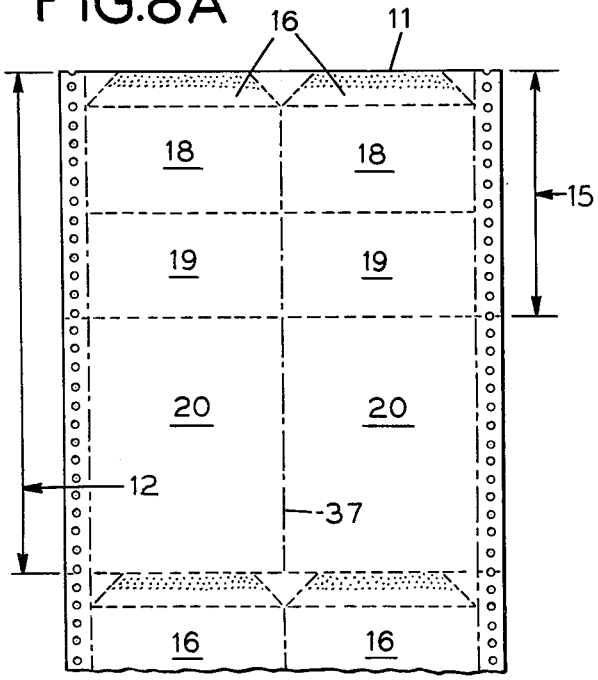
FIG.8B
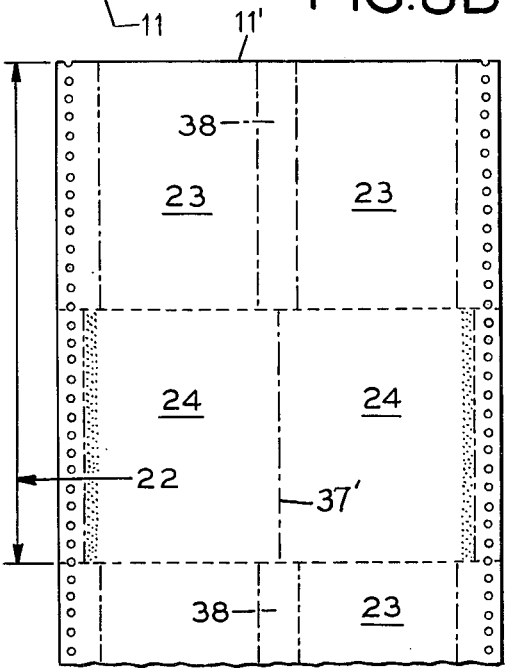

METHOD OF MAKING MULTIPLE ENCLOSURE MAILER

FIELD OF THE INVENTION

This invention relates to commercial methods and procedures for preparing large numbers of articles suitable for mailing, each of which comprises an envelope which contains multiple separate enclosures, which envelope and enclosures are prepared from two or more integral sheets. The invention has particular utility where many thousands or even millions of such articles having essentially the same format are to be addressed and mailed to individual recipients. Large volume mailings of this type are typically undertaken on behalf of firm's soliciting credit card applicants or magazine subscribers, or by charitable or membership organizations seeking contributions or new members. Similar mailings might be undertaken by governmental organizations or political sub-divisions in connection with taxing, licensing or registration functions. In the commercial field, the use of multiple enclosures, some or all of which have been personalized by inclusion of at least the receipient's name and preferably additional personal data are believed to have resulted in an increased favorable response to the solicitation.

DESCRIPTION OF THE PRIOR ART

This invention represents a further significant advance over the prior art and particularly that disclosed and claimed in U.S. Pat. No. 3,557,519 issued Jan. 26, 1971 to Randolph S. Lyon, Jr. That patent relates to a method of preparing an addressed envelope containing a single separate personalized lettersheet from an integral envelope-letter sheet of paper. The disclosure and teachings of U.S. Pat No. 3,557,519 are incorporated herein by reference. In the preparation of an article for mailing consisting of an envelope and multiple separate enclosures in accordance with the methods known to the prior art it was necessary to either (1) separately prepare all of the personalized enclosures and then insert them serially or in an assembled package into the envelope; or (2) if the method of U.S. Pat. No. 3,557,519 was employed, to thereafter insert the one or more additional separate personalized enclosures into the envelope which already contained the separate letter sheet.

SUMMARY OF THE INVENTION

The present invention provides a commercial method which can be operated in a continuous manner for directly producing articles suitable for mailing comprising an envelope containing separate, multiple enclosures, which method avoids the step or operation of inserting separate enclosures. In a preferred embodiment the separate enclosures are personalized.

In its broadest sense the method of the invention comprises the steps of temporarily joining or bonding in a mated configuration a first integral sheet from which an envelope and separate enclosure sheet are subsequently formed, and one or more additional integral multiple enclosure sheets from which a plurality of separate enclosure sheets are subsequently formed, folding said mated sheets in a prescribed sequence and configuration, trimming away the joined or bonded portions of the sheets, joining the side portions of the envelope and, while the envelope flap is open, separating the first and additional integral sheets along one of the prescribed fold lines to produce an envelope containing multiple separate enclosure sheets. In a preferred embodiment, this separation is accomplished by trimming a portion of the edges of the sheets behind the envelope flap.

The method has the particular advantage of permitting the rapid preparation of large numbers of envelopes each of which has more than one separate personalized enclosure sheet included in the envelope, which essentially eliminates the mismatching of the personalized enclosure sheets.

The terms "personalized" and "personalization" will be understood by those familiar with the art and include information regarding the recipient's name, address, sex, age, and other data which may be collected in demographic studies.

The method is particularly adapted and intended for use in conjunction with high speed web printing techniques and computer directed printing apparatus for personalizing the envelopes and enclosures.

The use of personalized enclosures in connection with commercial solicitations is believed to improve the likelihood of obtaining a favorable response from the recipient. The use of personalized enclosures, such as return mail forms not only expedites handling by the recipient, but can also expedite and improve record keeping by the sender. For example, should a government agency require up-dated personal information from an individual the method of the invention can be employed to transmit in a sealed envelope an instruction or advice letter along with one or more separate specialized forms with the individual's name and address printed thereon. After the required information is provided by the recipient, the form can be sent back to the agency in a return mailer which was also provided with the form. Since, the returned form has the individual's name printed on it, potential problems of illegibility and identity are avoided. The use of a partially completed form and enclosed return mailer will also improve the likelihood of a prompt response by recipient.

A further advantage of the method of the invention is that the separate enclosures all have the same orientation and can be removed from the envelope by the recipient in a nested configuration. This has the advantage that the recipient will be most likely to read or inspect the enclosures in the order desired by the sender.

The methods of the invention can readily be adapted to producing the articles desired in a variety of sizes and formats which are within the capabilities of commercial lithographic and computer directed printers, and the folding and converting equipment which is available in the art.

Additional specific uses and advantages of the various formats which can be embodied in the methods of the invention will be apparent to those familiar with the art in view of the teachings of this specification.

DETAILED DESCRIPTION OF THE INVENTION

In the drawings accompanying and forming part of this specification:

FIG. 3 is a side exploded perspective view illustrating the alignment for mating of two of the partially processed integral sheets from the continuous webs of FIGS. 1A and 1B;

FIG. 4 is a side view showing the first folding step partially completed on the aligned and joined integral envelope and first enclosure sheets and integral second and third enclosure sheets after die-cutting and bursting from the continuous paper web;

FIG. 5 is a side view of the elements shown in FIG. 4, illustrating the partially completed second folding step;

FIG. 6 is a side view of the elements shown in FIG. 5, illustrating the partially complete third folding step;

FIG. 7 is a cut-away, sectional side view showing the step of simultaneously separating and trimming the enclosure sheets and the top edge of the rear envelope panel;

FIG. 8A is a plan view showing a section of continuous paper web containing two envelopes and first enclosure sheets in parallel configuration; and FIG. 8B is a plan view showing a section of continuous paper web containing a pair of the additional enclosure sheets in parallel configuration.

Figure 1A:
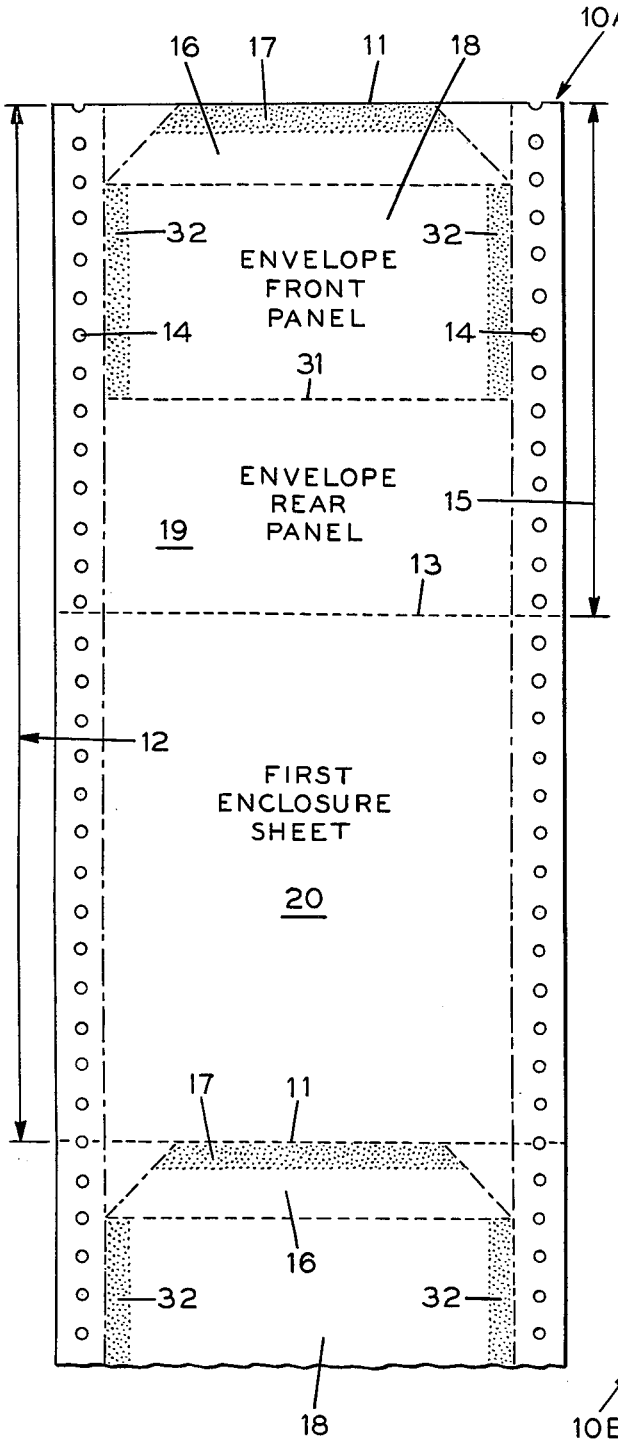
FIG. 1A is a plan view showing a section of continuous paper web containing the envelope and first enclosure sheet.

Referring to the drawings in detail wherein like reference characters designate corresponding parts throughout the several figures, and particularly to FIG. 1A there is shown web 10A which is divided by perforated cutting lines 11 into repeating composite sheets 12.

Figure 1B:
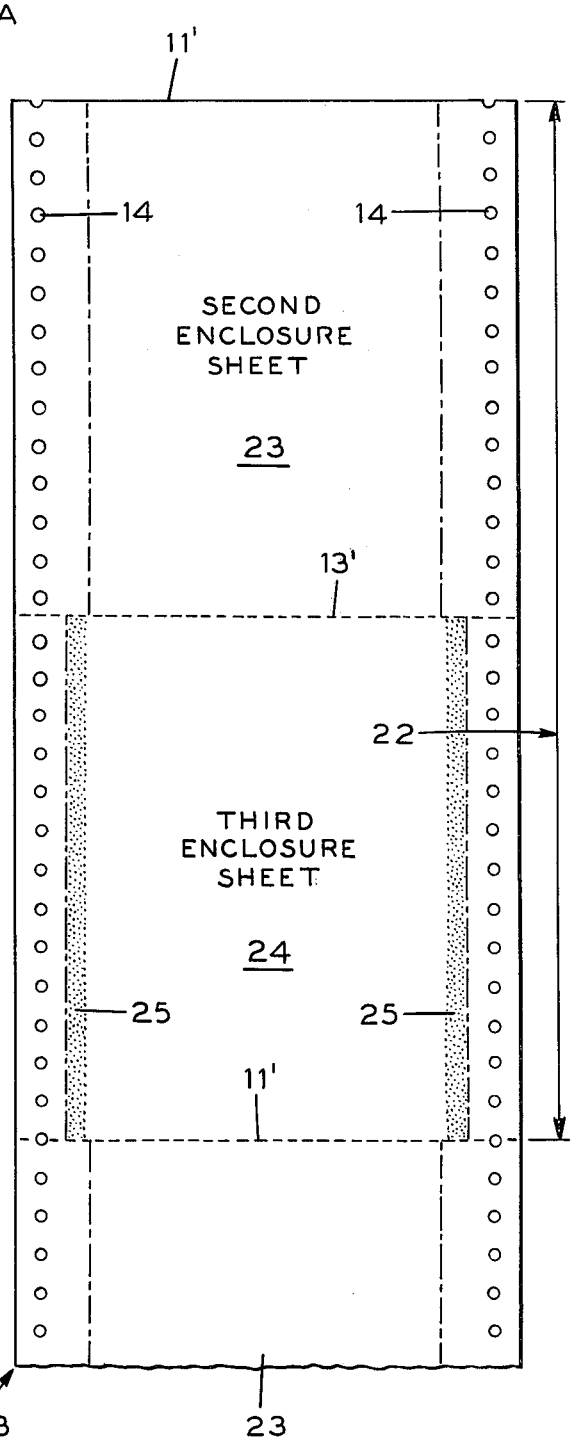
FIG. 1B is a plan view showing a section of continuous paper web containing the additional enclosure sheets.

In FIG. 1B there is shown web 10B which is likewise divided by perforated cutting lines 11' into repeating composite sheets 22.

Webs 10A and 10B are continuous forms, preferably lithographic webbing which has line holes 14 that are engaged by the computer directed printer for high speed feeding and proper indexing of the forms for insertion of the personalization. Webs 10A and 10B are also preferably provided with perforated folding lines 13 and 13', respectively, to facilitate fan folding.

As shown in FIG. 1A, the composite sheet 12 contains: an envelope sheet 15 defining a flap 16, to which a rewettable gum adhesive 17 can be applied, a front envelope panel 18 and a rear panel 19; and a first enclosure sheet 20. Envelope sheet 15 and enclosure sheet 20 are integral, being joined along perforated folding line 13.

As shown in FIG. 1B the composite sheet 22 contains a second enclosure sheet 23, and a third enclosure sheet 24 joined along perforated folding line 13'. It should be noted that the longitudinal edges of enclosure sheet 23 are positioned inside those of enclosure sheet 24. For the purpose of describing the methods of the invention with reference to the embodiment illustrated in FIGS. 1A and 1B, the distance between the longitudinal edges of sheet 24 is equivalent to that of sheets 19 and 20, and the relative positions of the sheets on the respective webs 10B and 10A are the same. Thus, by properly indexing the webs 10A and 10B, as by use of the line holes 14, the composite sheets 12 and 22 can readily be aligned in a super-posed configuration, that is, with sheet 24 over sheet 20 and sheet 23 over sheet 15, and thereafter moved as a unit.

Figure 2:
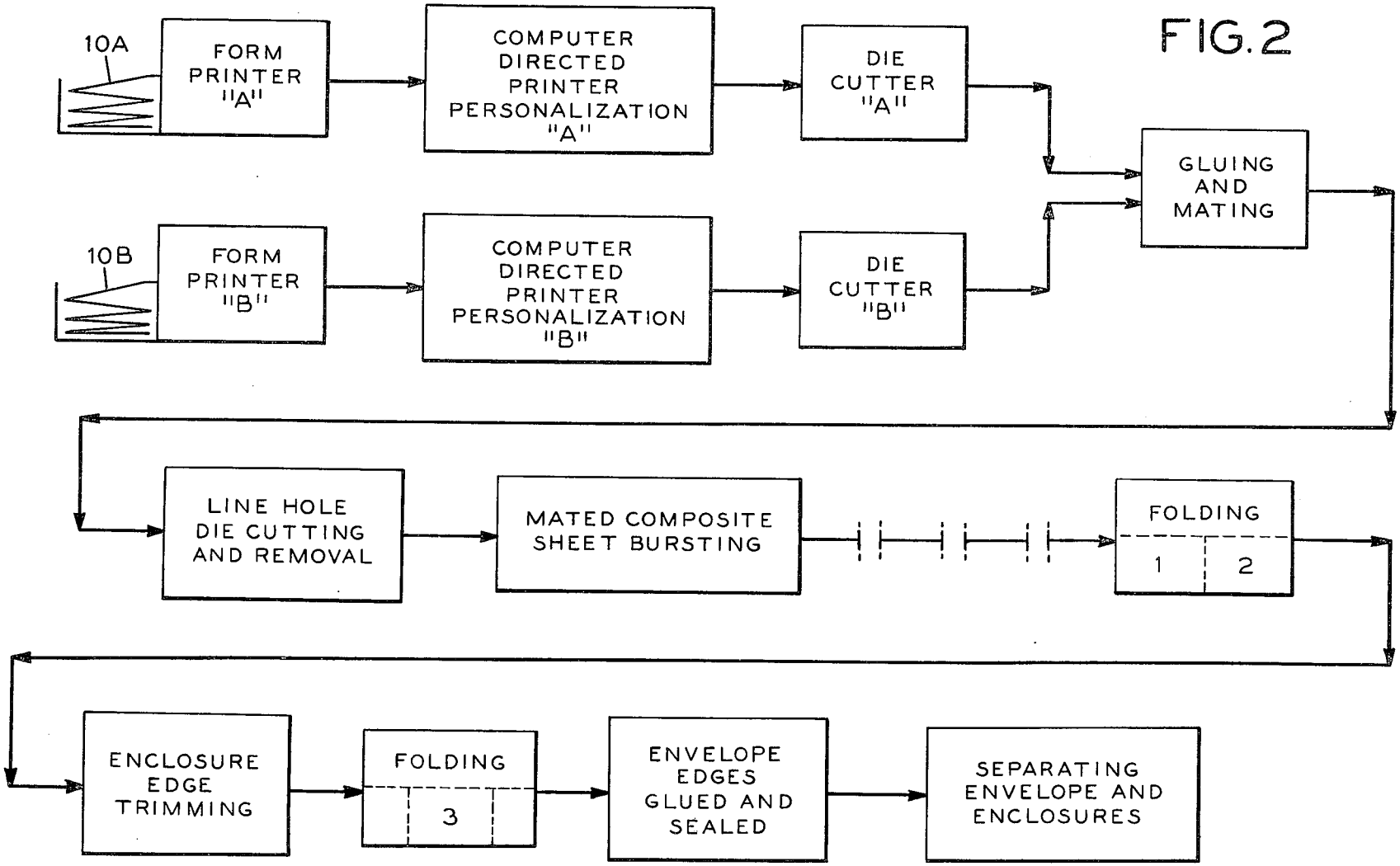
FIG. 2 is a schematic representation of the steps and operations employed in the practice of the method of the invention.

There is shown in FIG. 2 a schematic diagram illustrating generally the steps employed in practising an embodiment of the methods of the invention. From the previous description it will be understood that the blank web 10A is fed into Form Printer 'A' which is preferably a lithographic press which prints for example, a form letter appropriately positioned to correspond to the fields of enclosure sheet 20 of FIG. 1A. In a similar fashion, web 10B is fed into Form Printer 'B' which prints the fields of enclosure sheets 23 and 24 of FIG. 1B. Both sides of the sheets 12 and 22 can be printed.

The continuous webs exiting from the respective Form Printers 'A' and 'B' are then indexed and fed into Computer Directed Printers 'A' and 'B' for personalization. Conventionally, envelope sheet 15 will be printed with the name and address of the recipient and if enclosure sheet 20 is in a letter format, the name and address can be entered and a personalized salutation printed, along with any other desired personal data references in the body of the letter. Similarly, second and third enclosure sheets 23 and 24 can be personalized, as for example by printing the recipient's name on an invitation card and partially completing a return mail application form, both of which will become separate enclosures in the finally finished envelope.

As the webs 10A and 10B exit the Computer Directed Printers 'A' and 'B' they are optionally fed into Die-Cutters 'A' and 'B', respectively. With reference to FIG. 1A, the envelope sheet 15 can advantageously be die-cut at this point to provide the desired tapering configuration to the envelope flap 16. With reference to FIG. 1B, the shoulder between sheets 23 and 24, lying along line 11' can be die-cut to facilitate subsequent bursting steps described hereinafter.

As the webs 10A and 10B exit the optional die-cutting operation beads of adhesive are applied to either enclosure sheet 20 or 24, at a position just inside of its opposite longitudinal edges. With reference to FIG. 1B, the position of these liquid or hot melt adhesive beads 25 is shown, and they are preferably applied to sheet 24. Webs 10A and 10B are then brought into an aligned super-posed mating configuration, and pressed together so that they are joined and bonded together by means of the adhesive beads 25. Sheet 23 is not joined to envelope sheet 15 in this embodiment for reasons which will be made apparent below. Instead of using a separately applied adhesive, bonding can be accomplished by passing the sheets through crimping wheels or other crimping means which are known in the art.

By this method the printed personalized envelope and additional enclosure sheets are joined together during their subsequent movements and through the folding operations. This step of joining the envelope and personalized enclosure sheets together eliminates entirely any subsequent risk of mismatching and reduces greatly the need for quality control checks on the finished product which was associated with the prior art methods. This method of joining the composite envelope and enclosure sheets 12 and 22 also substantially eliminates the shifting and misalignment of the enclosure sheets during the high speed folding of the enclosures and envelope sheets.

Referring again to the schematic diagram of FIG. 2, the mated and glued webs 10A and 10B are fed into the Line Hole Die-cutting and Removal operation wherein the portions of the composite sheet 12 lying outside of envelope sheet 15 and first enclosure sheet 20, as well as the portions of composite sheet 22 lying outside of second and third enclosure sheets 23 and 24 are removed.

This step can be preferably accomplished by appropriately positioned slitting apparatus which make the necessary longitudinal cuts, and by then removing the opposite longitudinal edge portions of the webs 10A and 10B containing the line holes. The remaining portion of the web is then passed to the Mated Composite Sheet Bursting step where the continuous super-posed mated sheets are "burst," or separated along transverse cutting lines 11 and 11'. FIG. 3 illustrates, in an exploded perspective view, a section of the web, comprising two adjacent composite sheets following the line hole cutting and removal operation, and prior to the bursting operation.

Following bursting, the individual units consisting of integral sheets 15 and 20 joined to integral sheets 23 and 24 by adhesive means 25 are fed into a conventional multi-plate folding machine, where three transverse folds are made. The sequence and direction of the folds is illustrated in FIGS. 4, 5 and 6.

As shown in FIG. 4, the mated and joined first enclosure sheet 20 and third enclosure sheet 24 are folded transversely in the direction of the inside of the envelope panels along first transverse fold line 30. In the embodiment of FIG. 4, the position of fold line 30 is somewhat less than one-third of the distance between the free end of sheets 20 and 24 and perforated folding lines 13 and 13'. This position is preferred since it precludes further folding of the free ends of sheets 20 and 24 in the folding step illustrated in FIG. 6. However, this is an aesthetic consideration which applies to the specific embodiment being described in which first enclosure sheet 20 is in letter format. As will be apparent to one skilled in the art after having read the description of this specification, in employing the methods of the invention in connection with enclosures having various other formats or uses, other positions can be selected for transverse fold line 30.

As shown in FIG. 5, the mated and joined enclosure sheets 20 and 24 are next folded along a second transverse fold line which corresponds to perforated fold lines 13 and 13', respectively.

The third fold as illustrated in FIG. 6 is along the transverse line 31 between the front and rear envelope panels 18 and 19. As the second fold along lines 13 and 13' is made the opposite longitudinal edges of folded enclosure sheets 20 and 24 are trimmed off, as by a cutting wheel, and removed so that the transverse width of sheets 20 and 24 is approximately equal to that of enclosure sheet 23. This operation is depicted schematically in FIG. 2 just prior to Folding 3, as Enclosure Edge Trimming. As will be understood with reference to the above description, this trimming of the longitudinal edges of sheets 20 and 24 completely removes those portions of the sheets which were glued together and which up to that step held the sheets in a mated aligned super-posed configuration. Although trimming separates the joined sheets 15 and 20 from 23 and 24, their folded and nested configuration at this point precludes any undesirable shifting or misalignment during subsequent processing.

As will be appreciated by one familiar with the apparatus employed in the art the various steps depicted in the schematic diagram of FIG. 2 can be combined or re-arranged in order to accommodate the format of the composite sheets and the capabilities of the equipment available.

Again with reference to FIG. 2, in the next step, Envelope Edges Glued and Sealed, a bead of adhesive is applied along the opposite longitudinal edges of the inside of either the front or rear envelope panel 18 or 19, and the panel edges are brought into overlying alignment and pressure is applied to seal the opposite edges to form the envelope pocket containing the enclosure sheets. As illustrated in FIG. 1A, adhesive is applied to the opposite edges 32 of front panel 18.

As the final step, illustrated schematically in FIG. 2 as Separate Envelope and Enclosures, the folded enclosure sheet 20 is separated from the envelope panel 19 along line 13 and enclosure sheets 23 and 24 are separated from each other along line 13'. This step of separation of enclosures and can advantageously be combined with the final trimming of the exposed edges appearing behind the front panel of the envelope sheet. It is apparent that this step must be undertaken in connection with the illustrative embodiment depicted in the drawings in order to remove that portion of sheet 23 which overlaps flap 16 so that the finished envelope can be sealed. Thus a slitting device comprising scissor slitting wheels which is adjusted to the thickness of the paper stock so that the layers comprising: both ends of sheet 23; portions of sheets 19 and 20 lying adjacent to fold line 13 and the portion of sheet 24 lying adjacent to fold line 13', are all trimmed cleanly away. This is accomplished by temporarily bending the envelope flap 16 down and away by means of flap deflector 35, and passing the edges of the above identified sheets into the slitting wheels 36. This step is illustrated in FIG. 7 which is a cut-away section view showing the enclosure sheets and upper edge of the rear envelope panel being engaged by the cutting wheels 36, while the flap is held out of the way by flap deflector 35.

As a result of the final separation or trimming, there is provided by the method of this embodiment a personalized envelope containing three separate enclosure sheets in a nested configuration each of which enclosure sheets is also personalized. It is possible to provide additional enclosure sheets by mating additional composite sheets corresponding to 22 and proceeding with the practice of the method substantially as described above.

Depending upon the capacity of the lithographic and computer directed printing equipment, and the desired size and volume of the envelopes and enclosures to be produced, as well as other economic considerations which will be apparent to those familiar with this art, it may be preferred to use a plurality of composite sheets in parallel configuration. There is shown in FIGS. 8A and 8B typical composite sheets each of which comprises a line hole punched paper web containing in parallel configuration pairs of sheets corresponding to those shown in FIGS. 1A and 1B, respectively. In all other respects the parts of FIG. 8A correspond to those of FIG. 1A, and those of FIG. 8B correspond to FIG. 1B. In practicing the method of the invention employing the typical webs illustrated in FIGS. 8A and 8B, it is necessary to perform the obvious die-cutting and bursting operations to separate the parallel forms where they are joined along lines 37 and 37', respectively, and to remove paper strip 38 lying between the parallel second enclosure sheets.

The specific embodiment described above is intended to be representative and illustrative of the method of the invention which can be modified without departing from the spirit and the scope of the invention which is to be determined by the following claims.

What is claimed is:

1. A method of preparing an envelope containing multiple separate enclosure sheets which comprises:

a. mating in a superposed aligned configuration a first composite sheet consisting of:
   i. an envelope sheet defining a flap, a front panel and a rear panel, and integral therewith
   ii. a first enclosure sheet joined along a transverse line to said rear panel;

and a second composite sheet containing integral second and third enclosure sheets;

b. maintaining the mated configuration of the composite sheets by bonding means applied along a narrow segment adjacent to each, and lying between the opposite longitudinal edges of the superposed enclosure sheets;
c. folding the bonded composite sheets to position the enclosure sheets between the front and rear panels of the envelope sheets;
d. removing the bonded longitudinal edge segments while the sheets are in the folded configuration;
e. bonding the longitudinal edges of the front and rear envelope panels to form an envelope pocket containing the enclosure sheets; and
f. while the envelope flap is open, simultaneously separating the rear envelope panel from the first enclosure sheet, and the second from the third enclosure sheet, to thereby provide an envelope containing multiple separate enclosure sheets.

2. The method of claim 1, wherein the folding of step c is accomplished as follows:
a. folding the first and second enclosure sheets in the direction of the inside of the envelope panels along a first transverse line lying between the end and the center line of said enclosure sheets;
b. folding the folded first and second enclosure sheets along a second transverse line between the rear envelope panel and first enclosure sheet to a position over the inside of the envelope panels; and
c. folding said enclosure sheets and envelope panels along a third transverse line between the front and rear envelope panels.

3. The method of claim 1 wherein the third enclosure sheet is bonded in the superposed configuration to the first enclosure sheet, and the opposite longitudinal edges of the second enclosure sheet are positioned inside the longitudinal edges of the envelope sheet.

4. The method of claim 1 where the first and second composite sheets each form a part of separate continuous paper webs.

5. The method of claim 1 wherein the envelope and first enclosure sheet are personalized.

6. The method of claim 5 wherein the second composite sheet is also personalized.

7. The method of claim 1 wherein the bonding means of step b is a liquid adhesive.

8. The method of claim 1 wherein the bonding means of step b is crimping.

9. The method of claim 1 wherein the separating of step f is accomplished by trimming off a portion of the rear envelope panel and enclosure sheets along a transverse line adjacent the second transverse folding line.

10. The method of claim 1 which further includes the step of sealing the envelope flap to thereby provide an envelope containing multiple separate enclosure sheets ready for mailing.

11. A method of preparing an envelope containing multiple separate enclosure sheets which comprises:
a. mating in a superposed aligned configuration a first composite sheet consisting of:
   i. an envelope sheet defining a flap, a front panel and a rear panel, and integral therewith
   ii. a first enclosure sheet joined along a transverse line to said rear panel, and a plurality of composite sheets each containing a pair of integral enclosure sheets:

b. maintaining the mated configuration of the composite sheets by bonding means applied along a narrow segment adjacent to each, and lying between the opposite longitudinal edges of each of the superposed enclosure sheets;
c. folding the bonded composite sheets to position the enclosure sheets between the front and rear panels of the envelope sheet;
d. removing the bonded longitudinal edge segments while the sheets are in the folded configuration;
e. bonding the longitudinal edges of the front and rear envelope panels to form an envelope pocket containing the enclosure sheets; and
f. while the envelope flap is open, simultaneously separating the rear envelope panel from the first enclosure sheet, and the respective pairs of enclosures from the plurality of composite enclosure sheets, to thereby provide an envelope containing multiple separate enclosure sheets.

* * * * *